United States Patent [19]

Salvatore

[11] 4,027,406

[45] June 7, 1977

[54] METHOD OF LASTING SHOE UPPERS TO A LAST AND LASTED SHOE UPPERS AND ARTICLES OF FOOTWEAR PRODUCED THEREBY

[76] Inventor: Michael Salvatore, 68 Birch Lane, Greenwich, Conn. 06830

[22] Filed: May 13, 1976

[21] Appl. No.: 686,126

[52] U.S. Cl. ..... 36/83; 12/145

[51] Int. Cl.² ..... A43D 21/00; A43B 00/00

[58] Field of Search ..... 12/145, 142 R; 36/83

[56] References Cited

UNITED STATES PATENTS

| | | | |
|---|---|---|---|
| 3,230,559 | 1/1966 | Mayer | 12/145 |
| 3,374,496 | 3/1968 | Stubbings | 12/145 |
| 3,525,110 | 8/1970 | Batchelder et al | 12/145 |

*Primary Examiner*—Patrick D. Lawson
*Attorney, Agent, or Firm*—Paul R. Audet

[57] ABSTRACT

A lasting piece of shrinkable, preferably oriented thermoplastic polymeric material is attached, preferably by stitching, to a shoe upper lasting margin and is shrunk by being heated, if it is thermoplastic, to between its glass transition temperature and melting point. Shrinkage of the lasting piece lasts the shoe upper to the last. The lasting piece can be a lasting string, endless band or strip, or a sheet, web, net or welt. Lasted shoe uppers and articles of footwear are produced by the above method.

35 Claims, 35 Drawing Figures

METHOD OF LASTING SHOE UPPERS TO A LAST AND LASTED SHOE UPPERS AND ARTICLES OF FOOTWEAR PRODUCED THEREBY

BACKGROUND OF THE INVENTION

This invention relates to the manufacture of footwear. More particularly, this invention relates to methods of lasting shoe uppers to a footform or last, and to articles of footwear produced thereby.

Various methods of lasting such as cord, wire, string, slip and welt lasting of shoe uppers are well known in the manufacturing of footwear. In string lasting for example, a string is loosely attached to the marginal edge or lasting margin of a shoe upper for example, by a loose overstitch such that, when pulled, the string can slip within the confines of the overstitch. The shoe upper having the string attached thereto is then placed loosely over a footform or a last such that the shoe upper lasting margin is adjacent the last contoured or feathered edge which adjoins the last sides with the last bottom or sole. The lasting string is then drawn on pulled tightly to thereby gather, pull and draw a portion of the shoe upper lasting margin over the last feather edge to closely conform the shoe upper to the contour of the last, and the lasted-over margin to the contour of the last feathered edge and at least the outer margin of the of the last sole. This pulling-over operation also helps prevent wrinkles from appearing in the shoe upper above the sole. The shoe upper lasted-over margin is held in the lasted-over position by somehow attaching or fastening it to the last sole or to an insole placed thereover, the example, by cementing, tacking, stapling, stitching or molding operations, or by holding or tying the string, for example, by wrapping it around pins fixed to the last sole or to a shank thereon, until the attaching or other fastening operation is complete. The shoe upper is then ready for outsoling by cementing, nailing, stapling, sewing or for example, molding an outsole to its lasted-over margin to complete fabrication of the article of footwear.

Heretofore, the pulling of the lasting string to pull, draw or gather a portion of the shoe upper lasting margin tightly over the last feather edge, has been effected manually or mechanically. Either is disadvantageous for several reasons. A manual operation requires skill and great strength. It is hazardous it often cuts, bruises, and causes blisters and callouses on the operator's hands. Gloves or protective materials such as wrappings are usually required. These reduce dexterity and lessen effectiveness of the operation. It also results in a high turnover of personnel which in turn requires training and apprenticeship periods for new people during which there are hourly and daily variations in pulling strength, qualitative and quantitative variations in workmanship, and high spoilage. Another disadvantage of a manual operation is that heavy gauge leathers must be extensively and often repeatedly wetted to render then stretchable and lastable by human labor.

To overcome or avoid the aforementioned and other problems, complicated power-driven machinery is commonly employed to do the pulling, by, for example, power-driven arms having grasping means for grasping and pulling the lasting strings, or by pins or posts which are rotatably driven to exert a pulling force on lasting strings wrapped therearound. Mechanical means are also employed for wiping, for example, the toe portions of a shoe upper over the last to smooth out folds which sometimes occur due to the noosing and bunching of the material as it is gathered and drawn over the feather edge and forced to conform to various concave and convex shapes of the folds or the last. But, employing mechanical machinery for lasting operations is disadvantageous because it is very expensive. It requires high capital investment and frequent complicated maintenance, and it utilizes much energy. Another disadvantage of currently employed string pulling and holding methods is that the rotatably driven pins or posts on the last soles or shanks about which the lasting strings are wrapped, often are damaged or break and require repair, replacement or maintenance of the last.

Regardless of whether pulling of the lasting string is effected manually or mechanically, the lasting operation itself has heretofore been a bottleneck which has precluded fully automated, high-speed production of footwear. The pulling operation has heretofore not been considered to be fully automatable.

The method of this invention overcomes all of the aforementioned and other disadvantages by providing a method of lasting a shoe upper to a last, which eliminates the need for human or power-driven mechanical pulling forces and eliminates all of the problems associated therewith. The method is safe and is capable of providing consistent pulls of equal force which in turn provide monetary savings through consistent high quality lastings with little or no spoilage. Compared to power-driven mechanical means, the method is less costly. Capital investments are less and maintenance and energy requirements are less. Full automation of the drawing operation is feasible and allows for more uniform, higher quality, higher throughput production at lower cost. Also, the need for the lasting pins or posts and problems associated therewith can be eliminated.

BRIEF SUMMARY OF THE INVENTION

The method of this invention basically involves attaching to a shoe upper lasting margin, what is here generically termed a lasting piece made of shrinkable polymeric material, shrinking the polymeric material of which the lasting piece is made, and utilizing the shrinkage to gather, draw or pull a portion of the lasting margin over the feather edge of a last and thereby last the shoe upper to the last. The lasting piece preferably is made of an oriented, more preferably, an oriented thermoplastic polymeric material, and shrinkage thereof is effected by heating the material to an effective orientation reversal or reduction temperature, to reverse or reduce the level of orientation and utilize the consequent change in physical dimensions of the material, particularly its shrinkage or reduction in length, to last the shoe upper to the last. The lasting piece can be in the form of a lasting string, an endless band or strip, or a sheet, web, net or welt.

This invention is also in a method of forming an article of footwear wherein, in addition to the aforementioned steps, there is included the step of securing a sole to the lasted-over margin of the shoe upper.

This invention is also in the shoe uppers and articles of footwear formed by the aforementioned methods.

BRIEF DESCRIPTION OF THE DRAWINGS

In FIG. 29, the shoe upper is placed loosely about a last.

DETAILED DESCRIPTION OF THE DRAWINGS

Figure 1:
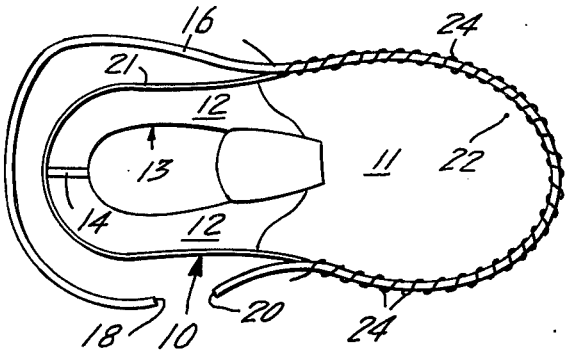
FIG. 1 is a bottom plan view of a shoe upper having a lasting piece in the form of a lasting string overstitched to a portion of the shoe upper lasting margin.

FIG. 1 is a bottom plan view of a shoe upper, generally designated 10, having a tongued vamp 11 stitched to quarters 12 having an ankle hole 13, a closed heel 14 and an open bottom. FIG. 1 shows a lasting piece, here shown in the form of a lasting cord or string 16 having free ends 18,20, partly attached to a portion, here, preferably edge 21 of the shoe upper lasting margin, generally designated 22, by suitable means, for example by stitching such as overstitching 24. Lasting string 16 is made of a shrinkable polymeric material, preferably an oriented polymeric, and more preferably, an oriented thermoplastic polymeric material, and is attached loose enough, as shown, to allow slight slippage thereof through the overstitching, yet tight enough to allow the string to gather, pull or draw at least a portion of lasting margin 22 over the adjoining portion between the sides and sole, i.e., the feather edge, of a form such as a footform or last, (28 in FIG. 3) when the lasting string is heated and shrunk, reduced in length or perimeter in accordance with the method of this invention.

Figure 2:
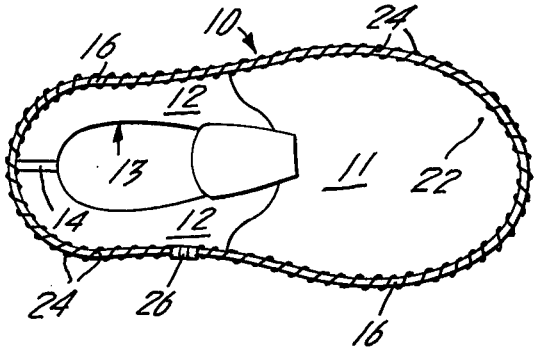
FIG. 2 is a bottom plan view of the shoe upper of FIG. 1 having overstitched to its perimeter a lasting string whose free ends are connected by an end connector.

FIG. 2, a bottom plan view similar to FIG. 1, shows the entire or substantially the entire length of oriented thermoplastic polymeric lasting string 16 attached to the perimeter of shoe upper 10 by overstitching 24. FIG. 2 also shows that lasting string free ends 18,20 (not shown) can be held in place and prevented from slipping through overstitching 24 during the above-mentioned shrinkage, or reduction in length or perimeter, by any suitable holding means, for example, by an end connector 26 which firmly holds the free ends in a connected, here, abutting or substantially abutting relationship.

Figure 3:
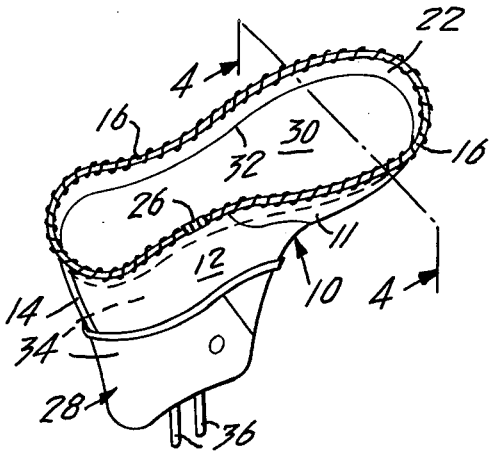
FIG. 3 is a perspective view showing the shoe upper of FIG. 2 loosely positioned on a last.

FIG. 3 is a perspective view showing shoe upper 10 of FIG. 2 having connected lasting string 16 overstitched thereto, after the shoe upper has been slipped over and loosely placed or positioned on or about a conventional footform or last 28, here, made of metal, in a manner that lasting string 16 is even with or, as shown, preferably at least slightly above the plane of adjacent portions of the last sole, generally designated 30. As shown in FIG. 3, preferably shoe upper edge 21 (not shown) and a portion of shoe upper lasting margin 22 are above last feather edge 32, which joins last sole 30 with last sides 34 (dashed line). FIG. 3 also shows that last 28 can include suitable means for heating it, for example, wires 36 connected to a suitable source of energy (not shown) for passing suitable energy such as electricity through the wires to heat at least last sole 30 and thereby heat lasting string 16, for reasons to be explained.

Figure 4:
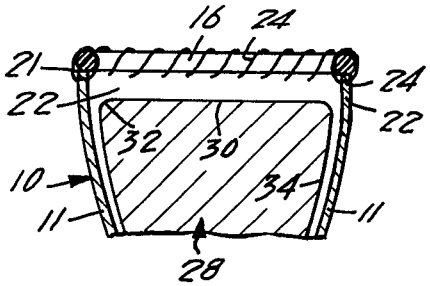
FIG. 4 is a cross-section, with portions broken away, taken along line 4—4 of FIG. 3.

FIG. 4 is a cross-section with portions broken away taken along line 4—4 of FIG. 3. The cross-section is taken through last 28, shoe upper vamp 11 and through lasting string 16. FIG. 4 clearly shows that shoe upper 10 is loosely positioned on the last, that lasting string 16, and preferably edge 21 and at least a portion of lasting margin 22 are above the plane of last sole 30, and that lasting string 16 is loosely attached to lasting margin 22 by overstitching 24.

Figure 5:
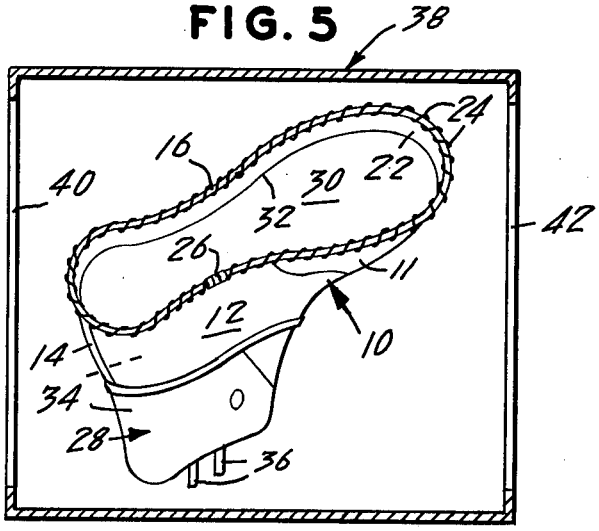
FIG. 5 is a vertical section through an enclosure within which a shoe upper is loosely positioned on a last as in FIG. 3.

FIG. 5 is a vertical section taken through an enclosure 38 for retaining heat, having an entrance 40 and an exit 42. FIG. 5 shows, within the enclosure, a perspective view of shoe upper 10 loosely mounted on last 28, as in FIGS. 3 and 4. While last 28 and mounted shoe upper 10 are in enclosure 38, energy carried through wires 36 heats last sole 30 and thereby indirectly heats the oriented thermoplastic polymeric material of which the lasting string is made. Lasting string 16 is heated to an effective orientation reversal or reduction temperature for the oriented thermoplastic polymeric material of which lasting string 16 is made, to reverse or reduce the extent level, or degree (hereafter extent) of molecular orientation of the thermoplastic polymeric material which thereby effects a change in physical dimensions, particularly, a shrinkage, retraction or reduction in the length and/or perimeter (hereafter generally referred to in terms of shrinkage) of lasting string 16, which gathers, pulls or draws (hereafter draws) shoe upper edge 21 (not shown) and all or a portion of shoe upper lasting margin 22 over last feather edge 32 and/or sole 30 into close, preferably tight relationship and conformity with the contours of last sides 34, feather edge 32, and the edges, face and marginal portions of last sole 30.

The energy used to shrink, preferably by heating, the lasting pieces of this invention can be of any suitable type, supplied from any suitable source, from any suitable location and applied directly or indirectly to lasting string 16 by any suitable means. For example, when the last is not itself directly heated, heating coils, heating plates, burners, steam, light or other sources of energy or heat can be provided in enclosure 38. The means shown is advantageous because it is conveniently widely employed for heating metal lasts to dry shoe uppers placed thereon, especially heavier gauge ones after they have been wetted to render them more stretchable and drawable over a last. Enclosure 38 can be a suitable oven adapted to quickly heat a lasting piece to an effective orientation reversing or reducing temperature while the last and shoe uppers mounted thereon are fed seriatum therethrough for high through-put production. The rate at which the lasts are fed through the oven, and therefore the time duration that the lasting pieces are exposed to heat depends for example on the temperature to which it is desired to heat the lasting piece to effect the shrinkage desired, which in turn depends on the type of polymeric material employed as the lasting piece, its extend of orientation, if any, and its glass transition temperature and melting point of temperature.

Figure 6:
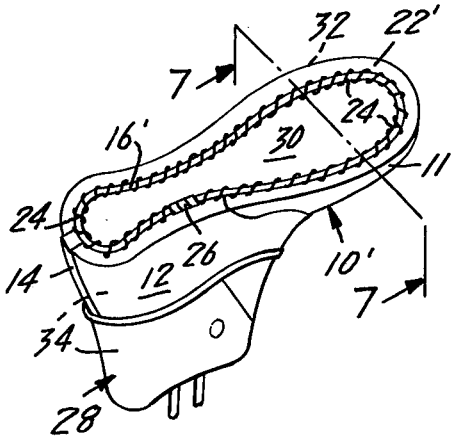
FIG. 6 is a perspective view of the shoe upper of FIG. 5 lasted to the last by the heating of the lasting string in the enclosure of FIG. 5.
Figure 7:
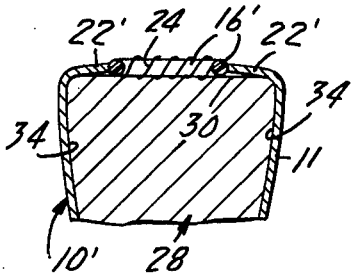
FIG. 7 is a cross-section taken along line 7—7 of FIG. 6.

FIG. 6, a perspective view, and FIG. 7, a cross-section with portions broken away taken along line 7—7 of FIG. 6, shows shoe upper 10 of FIGS. 3, 4 and 5 after overstitched oriented thermoplastic polymeric lasting string 16 has been heated in enclosure 38 of FIG. 5, to an effective orientation reversing or reducing temperature to last shoe upper 10 to last 28. More particularly, FIG. 6 shows that the heating of lasting string 16 to an effective orientation reversal or reduction temperature has caused a shrinkage which has drawn overstitching 24, upper edge 21 (not shown) and a portion of lasting margin 22 over last feather edge 32 (dashed line) and over the margin of last sole 30, to thereby last shoe upper 10 to last 28 and form lasting string 16' and lasted shoe upper 10'. The shrinkage has placed lasted-over margin 22' in close, preferably tight, conformity with the contours of last feather edge 32 and the margin of sole 30, and holds it there in a suitable position and condition for subsequent shoe finishing operations.

As shown in FIGS. 6 and 7, the perimeter of shrunk lasting string 16' encloses an area that is less than that enclosed by connected lasting string 16 in FIGS. 3 and 5, and less than the total surface area of last sole 30. Lasted shoe upper 10' can be removed or left on last 28 for additional shoe finishing operations.

Figure 8:
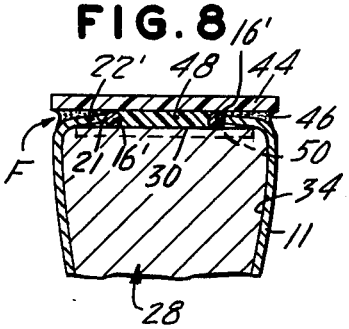
FIG. 8 is a cross-section through an outsole cemented to the lasted-over margin of the lasted shoe upper of FIG. 7.

FIG. 8, a vertical section with portions broken away similar to FIG. 7, shows, on a last, a finished shoe or article of footwear F made in accordance with the method of this invention. More particularly, FIG. 8 shows shoe upper lasted-over margin 22' having a shoe outsole 44 affixed or otherwise secured thereto by suitable means such as cement 46. FIG. 8 also shows that a suitable filler 48 can be provided to fill in, for example, the space or gap extending horizontally between shoe upper edge 21 and lasting string 16' and vertically between exposed portions of last sole 30 and shoe sole 44. Last sole 30 can include a conventional recess 50 (dashed line) therein, for receiving a conventional insole and/or sock lining (not shown) to which portions of lasted-over margin 22' and/or shrunk lasting string 16' and/or outsole 44 can be attached, fastened or affixed by any suitable means such as a chainstitch, tcks, nails, staples or cement.

Figure 9:
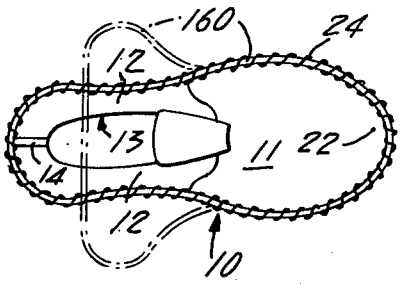
FIG. 9 is a bottom plan view of a lasting piece in the form of an endless lasting band overstitched to a shoe upper lasting margin.

FIG. 9 is a bottom plan view of a shoe upper generally designated 10, such as shown in FIGS. 1 and 2, having a tongued vamp 11 stitched to a quarter 12 having an ankle hole 13, a closed heel 14 and an open bottom. More particularly, FIG. 9 shows an alternative embodiment of the lasting piece of this invention in the form of an endless lasting band 160 attached, as in FIG. 2, to a portion of shoe upper lasting margin 22, here, along shoe upper edge 21 (not shown) by suitable means such as overstitching 24. The dashed line represents a portion of lasting band 160 before the entire length of the band was overstitched to shoe upper 10. As will be explained, preferably the entire or substantially the entire length of endless lasting band 160 or lasting string 16 is overstitched to shoe upper 10 and follows shoe upper edge 21, as shown for example in FIGS. 2 and 9, or follows lasting margin 22, as shown for example in FIG. 23.

Figure 10:
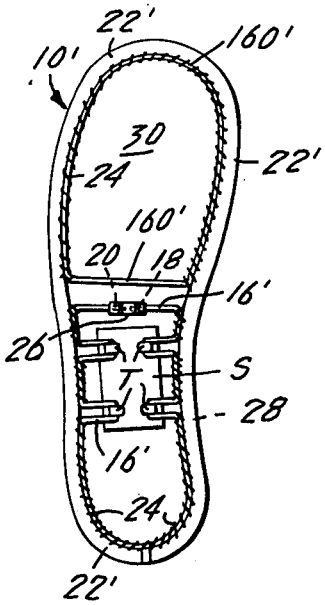
FIG. 10 is a bottom plan view of a shoe upper lasted to a last by an endless lasting band, and by a lasting string passed around tines of a shank.

FIG. 10 is a bottom plan view of the shoe upper of FIG. 9 lasted to a last 28 to form lasted shoe upper 10' by the use and cooperation of a combination of lasting pieces. More particularly, FIG. 10 shows a shrunk endless lasting band 160' overstitched to lasted-over margin 22' after shrinkage of the lasting band has drawn a portion of the lasting margin over the last feather edge (not shown), more particularly, over the margin of the forepart of the sole, i.e. its toe and ball portions. FIG. 10 also shows shrunk lasting string 16' overstitched to lasted-over margin 22' and whose free ends 18,20 (dashed lines) are connected and held by an end connector 26, after the lasting string has drawn a portion of lasting margin 22 over the last feature edge, more particularly, over the margin of the backpart of the last sole, i.e., its arch or shank and heel portions. Portions of shrunk lasting string 16' have been looped or passed, in a conventional manner, under shank tines T, which project or point inwardly away from the last feather edge and toward the longitudinal axis of shoe shank S, to provide the additional pulling and drawing force needed thereto pull and draw the arch portions of shoe upper 10 into tight conformity with the concave contours of the arch side and sole portions of last 28. FIG. 10 shows that oriented thermoplastic polymeric lasting strings, and endless lasting bands, of this invention can be heated to reverse or reduce their level of molecular orientation and their consequent shrinkage can be utilized to draw lasting margin in over variously shaped contours such as shanks, even though portions of such lasting pieces are wrapped or looped around pins, posts, prongs, or tines projecting from lasts or shanks, and even though lengths of, for example, lasting string 16 are looped over the portions of the overstitched lasting string at each side of a shank, such as is shown in U.S. Pat. No. 3,704,474 issued on Dec. 5, 1972. The pins, tines or devices about which such lasting pieces are looped or secured, can be made of any suitable materials including metals, but preferably they are made of materials, for example, relatively substantially higher melting point materials such as plastics, such as manufactured by E. I. DuPont de Nemours & Co. and sold under the trademark Teflon, which do not absorb heat at a rate faster than the lasting pieces, and which do not heat the lasting piece to a temperature which would melt or break the lasting piece or otherwise significantly deleteriously affect the drawing action of the lasting pieces of this invention. It is to be noted that according to this invention, any suitable number and combination of endless bands and lasting strings, or of patterns or modes of attachment to lasting margin 22, can be employed to draw and last a shoe upper to a last. Also, combinations of lasting pieces made of different oriented polymeric compositions, different extents and directions of molecular orientation, different orientation reversal temperatures and different percentages of shrinkage, can be cooperatively employed to draw and last various portions of a shoe upper lasting margin over variously contoured portions of a last.

Figure 11:
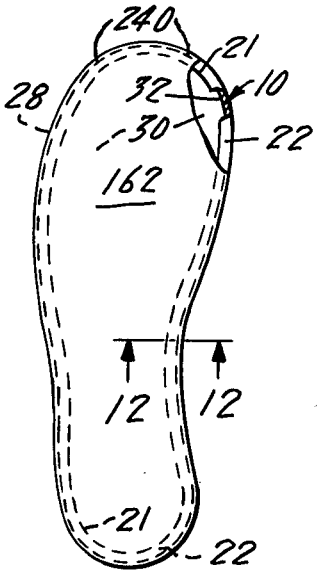
FIG. 11 is a plan view of a lasting piece in the form of a lasting sheet stitched to the lasting margin of a shoe upper loosely positioned on a last.

FIG. 11 is a bottom plan view of an alternative embodiment of a lasting piece which can be employed according to the method of this invention. More particularly, FIG. 11 shows a lasting piece in the form of a lasting film or sheet 162, preferably made of an oriented thermoplastic polymeric material, attached along its marginal edge portion to a portion of lasting margin 22 by suitable means such as stitching 240. Lasting sheet 162 has not yet been heated and shrunk and, therefore, shoe upper 10 is loosely positioned on last 28 (dashed line) such that lasting margin 22 overlies a portion of the margin of last sole 30. Preferably, edge 21, along or in addition to a portion of lasting margin 22, is even with or overlies the plane of, or lies on a portion of, last sole 28.

Figure 12:
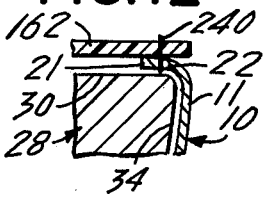
FIG. 12 is a cross-section taken along line 12—12 of FIG. 11.

FIG. 12, a cross-section with portions broken away taken along line 12—12 of FIG. 11, shows the manner in which lasting sheet 162 is stitched to shoe upper lasting margin 22, and it shows that a portion of shoe upper lasting margin 22 overlies a portion of last sole 30.

Figure 13:
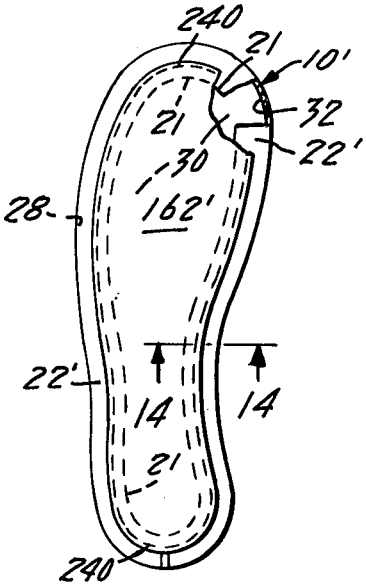
FIG. 13 is a bottom plan view of the shoe upper of FIG. 11 lasted to a last by shrinking the lasting sheet of FIG. 12.

FIG. 13 is a bottom plan view which shows that lasting sheet 162 of FIG. 11 becomes shrunk lasting sheet 162' after lasting sheet 162 has been heated and its level of molecular orientation reversed or reduced according to the method of this invention. FIG. 13 shows that shrinkage of lasting sheet 162 which occurred during the reversal or reduction of its orientation, resulted in lasted-over margin 22' being pulled, drawn or constricted tightly over last sole 30, which thereby lasted shoe upper 10 to last 28 and formed lasted shoe upper 10'.

Figure 14:
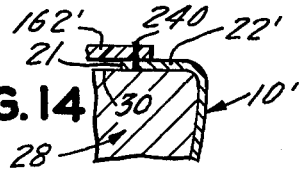
FIG. 14 is a cross-section taken along line 14—14 of FIG. 13.

FIG. 14, a cross-section with portions broken away taken along line 14—14 of FIG. 13, clearly shows that the heating of lasting sheet 162 shrunk it to form shrunk lasting sheet 162' which thereby caused lasted-over margin 22' of lasted shoe upper 10' to be tightly drawn into close conformity with last 28.

Figure 15:
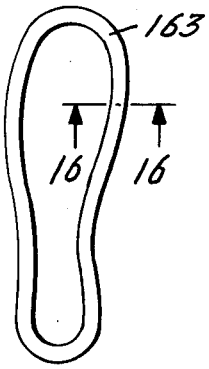
FIG. 15 is a plan view of a lasting piece, in the form of an endless lasting strip.
Figure 17:
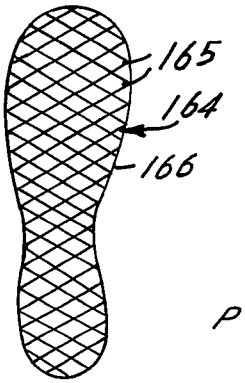
FIG. 17 is a plan view of a lasting piece in the form of a lasting web or net.
Figure 18:
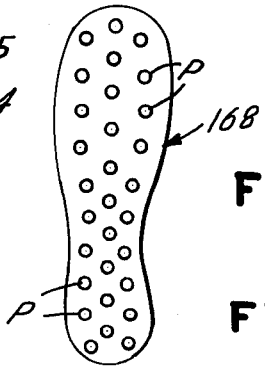
FIG. 18 is a plan view of a lasting piece in the form of a perforated lasting sheet.

FIGS. 15, 17 and 18 are plan views of alternative embodiments of lasting pieces, which can be employed for lasting shoe uppers to lasts in accordance with this invention. Preferably, the lasting pieces are made of oriented thermoplastic polymeric materials. FIG. 15 shows a lasting strip 163 which need not be but preferably is endless and which can be attached by suitable means to a portion of a shoe upper lasting margin. When lasting strip 163 is not endless, its free ends (not shown) can be connected by suitable connecting means (not shown).

Figure 16:
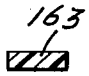
FIG. 16 is a cross-section taken along line 16—16 of FIG. 15.

FIG. 16, a cross-section taken alone line 16—16 of FIG. 15, shows the height and width of endless lasting strip 163.

FIG. 17 is a top plan view of a lasting net or web 164 which can be one piece, as a scrim, or comprised of criss-crossed strands whose non-marginal intersecting portions can be but preferably are not fused to one another, and whose intersecting connecting marginal end portions 165 preferably are fused to one another to facilitate the stitching of the fused portions to a shoe upper edge or other portion of a lasting margin. Lasting web 164 preferably has a perimetal boundary 166 connected or fused to connecting end portions 165, which can be stitched or otherwise attached to a shoe upper.

FIG. 18 is a top plan view of a lasting film or sheet 168 having perforations P therein. The perforations are of a number, shape, spacing and arrangement which will not prevent the lasting sheet from being used in accordance with this invention. The lasting pieces of this invention, especially those designated 162 (FIG. 11), 163, 164 and 168, can be attached to shoe upper lasting margins by any suitable means including stitching, threading (FIG. 29), adhesion, cementing, bonding, fusing by heat, stapling and tacking.

Figure 19:
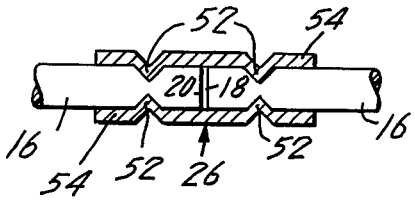
FIG. 19 is a vertical section taken transaxially through the shank of FIG. 10.

FIG. 19 is an enlarged vertical section as would be taken through the length of end connector 26 of FIG. 10. FIG. 19 shows lasting string free ends 18,20 engaged by and held in an abutting or substantially abutting relationship by end connector 26 having opposing dents or crimps 52 in its cylindrical wall 54. End connector 26 can be of any suitable size, shape and configuration and can be made of any suitable material, for example, a metal or thermoplastic.

Figure 20:
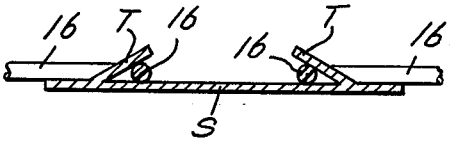

FIG. 20, a vertical section with portions broken away as would be taken transaxially through shank S of FIG. 10, shows portions of lasting string 16 looped under shank tines T.

Figure 21:
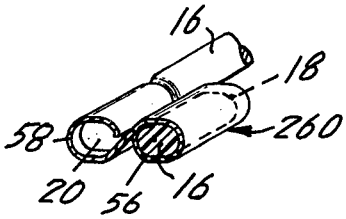
FIG. 21 is a cross-section as would be taken through an alternative lasting string end connector.

FIG. 21 is a cross-section as would be taken vertically through an alternative embodiment of a lasting string end connector, which can be employed in accordance with this invention. More particularly, FIG. 21 shows a portion of an S-shaped end connector 260 whose downwardly curved and upwardly crimped leg 56 substantially encompasses and holds a portion of lasting string 16 near its free end 18, and whose upwardly-curved, downwardly-crimped leg 58 substantially encompasses and holds a portion of the lasting string near its free end 20.

Figure 22:
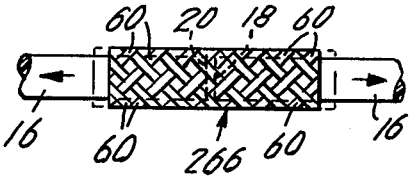
FIG. 22 is a front elevation of an alternative embodiment of a lasting string end connector.

FIG. 22 is a front elevation of another embodiment of a lasting string end connector. FIG. 22 shows a cylindrically-shaped, webbed, end connector 266 which can be made of plastic or another flexible material and whose body wall, comprised of interwoven strands 60, circumferentially contracts upon and grasps portions of lasting string 16 adjacent its free ends 18,20. These portions are grasped with increasing tightness as the pulling force exerted in opposite directions (see arrows) on portions of lasting string 16 increases, such as when the lasting string is heated and shrunk in accordance with the method of this invention.

Figure 23:
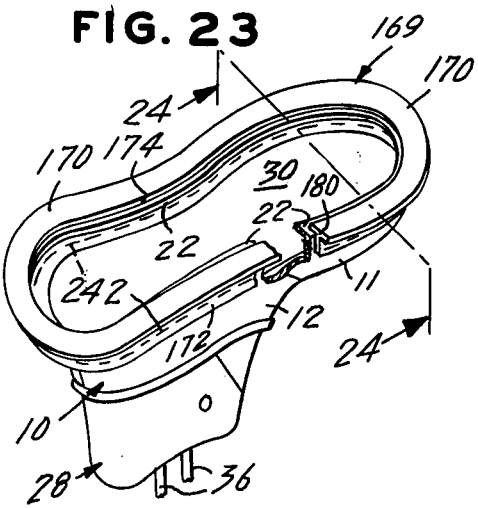
FIG. 23 is a perspective view with portions broken away, of a lasting piece in the form of a lasting welt stitched to the perimeter of a shoe upper loosely positioned on a last.

FIG. 23 is a perspective view, with portions broken away, of a shoe upper 10 loosely positioned on last 28 and having stitched to its lasting margin 22, an alternative embodiment of a lasting piece of this invention, here, a lasting welt, generally designated 169. Although lasting welt 169 can be of any suitable size and shape, preferably it is T-shaped when viewed in cross-section and is comprised of a substantially horizontal top 170, and a vertically depending leg 172 attached along its length to shoe upper lasting margin 22 by suitable means such as stitching 242. Lasting welt 169 is stitched to lasting margin 22 in a manner that its free ends 180 (one shown, other free end broken away) would abut or substantially abut one another. Lasting welt 169 can be endless if desired.

Figure 24:
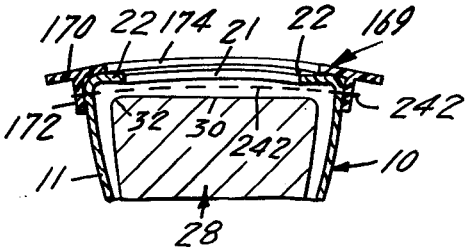
FIG. 24 is a cross-section, with portions broken away, taken along line 24—24 of FIG. 23.

FIG. 24 is a cross-section, with portions broken away, taken along line 24—24 of FIG. 23, through last 28, shoe upper 10 and lasting welt 169. FIG. 24 shows that shoe upper 10 is loosely positioned on last 28 such that shoe upper edge 21 or inside edge 174 of welt top 170 or both, are on, over or above the plane of, or are in a position relative to last edge 32, to allow either or both of them to be drawn tightly over or onto the margin of last sole 30 during the carrying out of the method of this invention. Thus, for example, if lasting welt 169 is sewn to lasting margin 22 close to edge 21, such that edge 21 faces the underneath of welt top 170, then preferably at least the inside edge 174 of lasting welt 169 is in a position, such as above the plane of last sole 30, to allow lasting welt 169 to draw the inside portion of welt top 170 and preferably also lasting margin 22 tightly over the margin of last sole 30 in accordance with the method of this invention, so that a suitable sole can be secured to the welt or shoe upper lasted-over margin.

Figure 25:
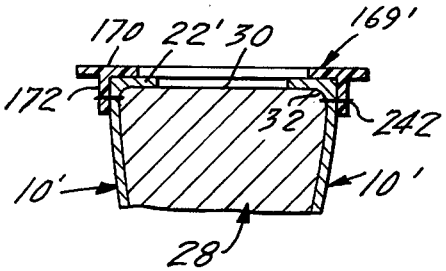
FIG. 25 is a cross-section with portions broken away showing the welt-stitched shoe upper of FIGS. 23 and 24 lasted by virtue of the heating of the lasting welt.

FIG. 25 is a cross-section as would be taken along line 24—24 of FIG. 23 after the heating of lasting welt 169 and after it has shrunk and its perimeter has reduced in accordance with the method of this invention. More particularly, FIG. 25 shows that the heating of lasting welt 169 in accordance with the method of this invention and the reversal or reduction in its orientation, has formed shrunk lasting welt 169′ and has pulled, gathered, drawn or constricted lasting margin 22 tightly over last sole 30 to last shoe upper 10 to last 28 and thereby form lasted shoe upper 10′ having a lasted-over margin 22′, which is ready for subsequent shoe finishing operations.

Figure 26:
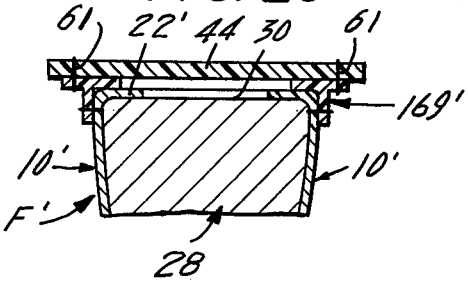
FIG. 26 is a cross-section through an outsole stitched to the welt by the lasted shoe upper of FIG. 25.

FIG. 26, a cross-section similar to that of FIG. 25, shows an outsole 44 seamed or attached to shrunk lasting welt 169′ by suitable means such as stitching 61 to thereby form a shoe or article of footwear F′.

Figure 27:
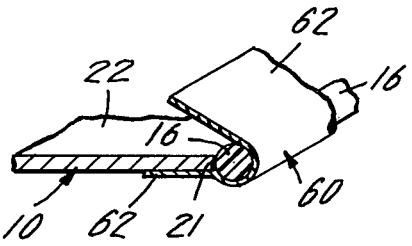
FIGS. 27–29 are perspective views with portions in cross-section and portions broken away, showing methods of attaching a lasting string to a shoe upper by means of an attaching piece.
Figure 28:
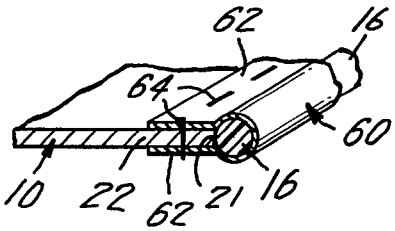
Figure 29:
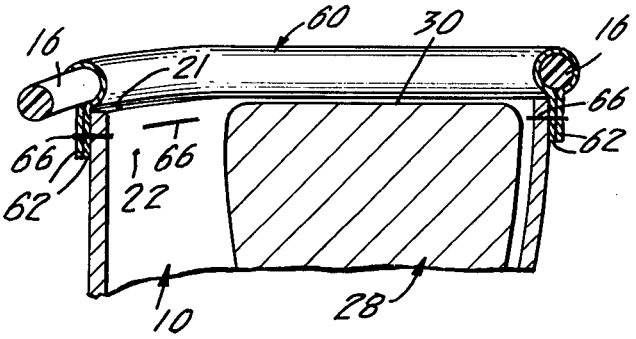

FIGS. 27–29 show suitable methods and means by which a lasting piece, here, lasting string 16, can be attached, fastened, or secured to a shoe upper and utilized in accordance with this invention. More particularly, FIGS. 27–29 show that an elongated attaching piece 60 can be folded over a lasting string 16, and the attaching piece's longitudinal edge portions 62 can be secured by suitable means to a shoe upper lasing margin 22. FIGS. 27 and 28 show that one method of utilizing attaching piece 60 is to place a portion of a shoe upper lasting margin 22 on a longitudinal edge portion 62, place lasting string 16 on the attaching piece along shoe upper marginal edge 21, fold the attaching piece over lasting string 16 so that the longitudinal edge portions 62 straddle a portion of lasting margin 22, and secure or attach the edge portions thereto by suitable means, for example, by thread or stitching 64. Other suitable means include adhesives, cement, staples, etc.

FIG. 29 shows that longitudinal edge portions 62 need not straddle the shoe upper lasting margin, but, either before or after receiving lasting string 16, preferably before, they can be placed next to and either cemented, stitched, stapled or otherwise attached to each other, or not, and then attached to shoe upper lasting margin 22 by suitable means, for example, by stitching 66. FIG. 29 also shows that a shoe upper 10 having an attaching piece 60 secured thereto, can be placed about a last 30 in preparation for lasting by the method of this invention.

Attaching piece 60 can be made of any suitable natural and/or synthetic material that is strong enough, flexible enough and has a sufficiently high melting point or temperature to allow the heating and shrinking of a lasting string or even a lasting strip to last the shoe upper to a last in accordance with the method of this invention. Attaching piece 60 can have openings therein to enable more heat to pass therethrough and be applied to lasting string 16.

Figure 30:
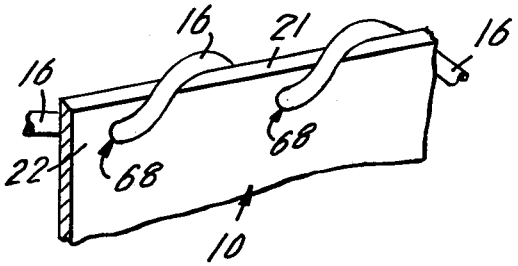
FIG. 30 is a perspective view, with portions in section and portions broken away, showing another method of attaching a lasting string to a shoe upper.

FIG. 30 shows that lasting string 16 can be attached or secured to shoe upper 10 by threading the lasting string through holes 68 spacedly placed in and along lasting margin 22. The lasting string need not pass or cross over marginal edge 21.

Figure 31:
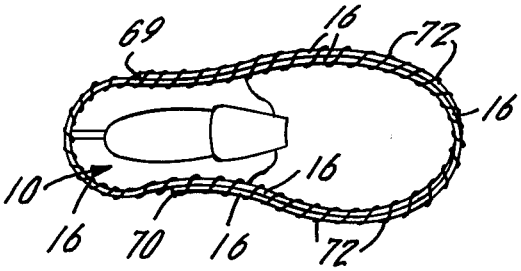
FIG. 31 is a bottom plan view, with portions broken away, showing a lapped lasting string overstitched to a shoe upper.
Figure 32:
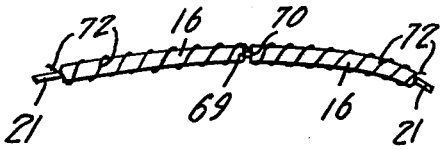
FIG. 32 is a top plan view, with portions broken away, showing a lasting string having its ends in a substantially abutting relationship and overstitched to a shoe upper.

FIG. 31 shows that lasting string free ends 69,70 need not be connected to each other by an end connector. Rather, and preferably, portions of lasting string 16, including those adjacent free ends 69,70, can be placed in any suitable lapping or overlapping relationship with other portions of the lasting string, and the overlaps can be overstitched by overstitching 72 to a portion of a shoe upper 10 along its marginal edge 21 (not shown). Preferably, overlapping occurs at the arch and/or other areas of the shoe upper such as the toe, where the lapped portions can provide the additional drawing or pulling action often needed at such highly contoured areas. If desired, the end portions of the lasting string can be tied to each other (not shown), or free ends 69,70 can merely abut or substantially abut each other as in FIG. 32. The ends can be further spaced than as shown in FIG. 32, as long as the spacing does not prevent portions of a shoe upper lasting margin between the ends from being suitably drawn or pulled over a last feather edge.

Figure 33:
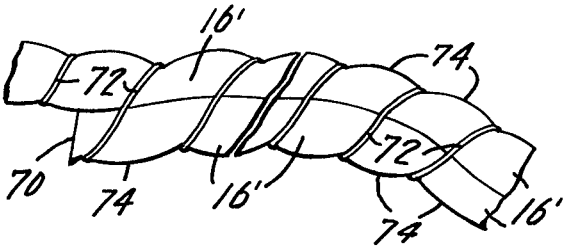
FIG. 33 is an enlarged schematic view, with portions broken away, showing portions of the lapped end portions of the lasting string of FIG. 31, after the string has been heated in accordance with the method of this invention.

FIG. 33 is an enlarged schematic view, with portions broken away, showing a portion of the lapped lasting string of FIG. 31 adjacent free end 70, after the lasting string has been heated in accordance with the method of this invention. FIG. 33 shows that shrinkage of the polymeric material such as by the heating of the thermoplastic polymeric lasting string or lasting piece material or materials not only causes a reduction in its level of orientation and a consequent shrinkage or reduction of its length, but it also may cause certain lasting string materials to swell or increase in diameter, as generally indicated at 74. This swelling can cause lasting string portions axially between spaced loops of overstitching 72, to move radially outward beyond the circumferential confines of the loops of overstitches and tend to frictionally anchor or hold the lasting string and prevent it from moving axially through the loops or overstitches while shrinkage is occurring. To a slight extent, axial movement may also be hampered by friction between lapped lasting string portions that contact or abut one another within the confines of the overstitching.

Figure 34:
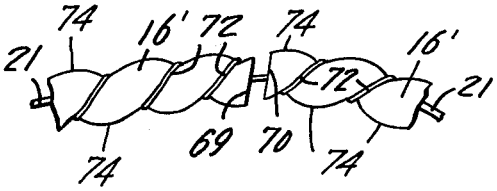
FIG. 34 is an enlarged view showing end portions of the lasting piece of FIG. 32 after the string has been heated in accordance with the method of this invention.

FIG. 34 shows that the aforementioned swelling and anchoring action against axial movement of lasting string 16 can occur when portions of the lasting string are not lapped. The tightness of overstitching 72 can be as desired. The stitching should not be so slack that the shrinkage of and constriction of, for example a lasting string or an endless lasting band, merely takes up the slack. The stitching should be tight enough, especially when the ends of the lasting string are free as in FIGS. 31 and 32, to anchor the lasting string without cutting through it. However, it has been found that even when the swollen lasting string is cut through by overstitching in a few, or several or more places, anchoring at other places along the lasting string is sufficient that the shoe upper can still be effectively and efficiently lasted to a last. The amount of swelling which occurs with a given shrinkable polymeric, preferably thermoplastic polymeric material, is a function of the characteristics of the particular material, of the manner and degree that it was oriented and the extent of reduction of its orientation during heating. Usually, the greater the reduction in orientation and decrease in length, the greater the swelling.

Figure 35:
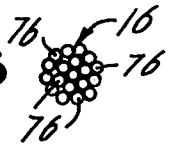
FIG. 35 is an enlarged elevational end view of a multifilament lasting string.

FIG. 35 is an enlarged elevational end view of a multifilament lasting string 16 made of a plurality of monofilaments 76. The monofilaments can be solid or hollow when viewed in cross-section. Braided or twisted monofilaments can also be employed. Preferably, each monofilament is made of the same material, although each can be made of different materials. For example, the lasting string as a whole, or each or some of the monofilaments can be covered or coated by, or each monofilament can be made of a band of polymeric, preferably thermoplastic, materials, or of copolymers of the materials.

The lasting pieces employed in accordance with the method of this invention are made of shrinkable, preferably polymeric, materials. Usually, the polymeric materials are linear and of high molecular weight. Preferably, the polymeric materials are oriented, and most preferably, they are oriented and thermoplastic. The oriented polymeric materials which can be employed include substantially crystalline, semi-crystalline, substantially amorphous, and very lightly cross-linked or networked materials capable of being drawn at temperatures above their melting points or melting temperatures. Although materials whose orientation has been heat set can be employed, it is not desirable because too high temperatures are required to release orientation. At such temperatures there tends to be an undesirably excessive flow and loss of shrinkage force.

Substantially crystalline oriented thermoplastic polymeric materials, for example, nylon, polyethylene, polypropylene, isotactic polystyrene, poly(1-butene) and saran, and semi-crystalline materials, for example, polyethylene terephthalate are preferred because they can be oriented and their extent of orientation can be reversed, reduced or released by heating them between their second order or glass transition temperatures and their melting points. Substantially amorphous polymeric materials, for example, polyvinyl chloride, atactic polystyrene, polycarbonates, acrylics such as polymethyl methacrylate, and rubbers, such as polyisobutylene, can be oriented at temperatures from about 10° to 40° C. above their glass transition temperatures, and their extent of molecular orientation can be reversed, reduced or released by heating them to about the temperature at which they were oriented, or thereabove if quick release of orientation is desired. The temperature at which a material has been oriented is easily discernable by heating the orientated material until it starts to shrink. At approximately that temperature, orientation occurred. Very lightly cross-linked materials, such as very lightly cross-linked polyethylenes, can be oriented and their extent of orientation released at temperatures above their melting point. Their slight cross-linking provides sufficient restraint to flow to prevent excessive flow above the melting point.

The preferred lasting pieces are lasting strings made of oriented thermoplastic polymeric materials whose extent of molecular orientation is, as previously stated, reversable or reducable when the material is heated to a temperature that is higher than its glass transition temperature but lower than its melting point or temperature. Regardless of the type of oriented polymeric material employed, its molecular orientation must be reversable or reducable to an extent that the shrinkage of the material which occurs during the reversal or reduction, draws all or a portion of the lasting margin of a shoe upper to which the lasting piece is attached, over a portion of a last feather edge and/or sole and thereby lasts the shoe upper to the last.

As is well known, an oriented polymeric material is a polymer material which has been drawn, extended or stretched such that its polymer molecules, which say, for example, were amorphous or entirely random and without order in the unstretched material, are, in the stretched material, more oriented or aligned in the direction of stretching. Molecular orientation of polymeric materials is a well known art. Its practice is usually discussed in terms of the four mechanical behavior-defined physical states which occur at different temperatures. These states are termed glassy, leathery, rubbery and viscous. The glassy state corresponds with the lowest temperature range and the viscous with the highest. In terms of molecular behavior, in moving through temperatures from the glassy to the viscous state, polymeric molecules are progressively freer to uncoil, and move in relation to and slip past one another. In terms of viscoelastic behavior, combined stress/time and strain/time diagrams indicate that in the glassy state, the application of stress produces a small instantaneous deformation which remains until the stress is removed; in the leathery state, often described as "retarded highly elastic", stress produces a small instantaneous strain which continues to relatively slowly increase indefinitely; in the rubbery state, it produces an almost instantaneous highly elastic deformation and removal of stress produces a virtually instantaneous elastic recovery; and, in the viscous state, it produces substantial plastic flow which is virtually irreversible.

Generally speaking, thermoplastic polymers such as substantially amorphous, crystallizable polymers are usually oriented by stretching while they are in the leathery or rubbery state. Thermoplastic polymeric materials are usually oriented over a range of temperatures, often termed the orientation temperature range for the particular material. U.S. Pat. No. 3,141,912 issued on July 21, 1964 defines this range as lying somewhere below the crystalline melting point of a crystalline polymer that melts over a narrow range of temperatures. For some crystalline polymers such as polyethylene, polypropylene and other polyolefins, the Patent states that the orientation range may be that within which the crystallites melt and are no longer detectable, and that for substantially amorphous, crystallizable polymers, for example, polyesters such as polyethylene terephthalate and the like, the range is from about 10° to 40° C above the second order or glass transition temperature of the polymer. Specific orientation temperature ranges vary from polymer to polymer but may be determined by experimentation or from currently available literature. The aforementioned Patent discloses orientation temperature ranges of representative amorphous polymers, crystalline polymers, and crystallizable polymers that are amorphous as quenched. Representative melting temperatures of about 850 polymers are listed in Chapter III of Polymer Handbook, by J. Brandrup and E. H. Immergut (with J. G. Elias), Interscience Publishers, a Division of John Wiley & Sons, 1965.

The level of orientation obtained by stretching within the orientation temperature range depends upon the conditions under which the polymer is oriented. Higher levels of orientation result from increasing the amount of stretch, by increasing the stretch rate, and/or by decreasing the stretching temperature.

Orientation of polymeric materials can be effected by any suitable means. For example, in the fibre industry, it is well known that thermoplastic polymers such as polyethylenes, nylons, and polyethylene terephthalates, molten, or dissolved in suitable solvents, are extruded as thin filaments through fine holes of a plate or spinneret. On emerging therefrom, the molten polymer is rapidly cooled, or the dissolved polymer is placed in a suitable precipitant or dried, to form solid filaments which can be drawn or stretched. Preferably, the filaments are as amorphous as possible, although some orientation does occur during extrusion, for example, in the case of polymers which rapidly crystallize, or when extrusion occurs at a very slow rate. Industrially, the extruded solid filaments are drawn, extended or stretched by passing them between and winding them over sets of rollers, the second set having a higher rotational speed. The fibre may be passed over heated plates between rollers to facilitate molecular motions involved in orientation and crystallization. The ratio of the surface speeds of the rollers determines the percentage of extension of the fibres. Draw ratios amounting to several hundred percent may be effected. For example, nylon 6,6 can be hot or cold drawn 500 percent, polyethylene terephthalates such as sold by I.C.I. Ltd. under their trademark Terylene, a polymer of terephthalic acid and ethylene glycol, can be hot stretched up to five times, and polyethylenes can be cold drawn about six times their original undrawn length. Drawing filaments in this manner increases their length and their physical properties such as tenacity, but decreases their diameters and their elongation or extension at break. The tenacity and elongation at break values of man-made polymeric fibres can be found in Man-Made Fibres, by R. W. Moncrieff, John Wiley & Sons, 6th Edition, 1975.

Tensile strength and extension at break values of common polymers at 20°–25° C. are listed in tables on pages 602 and 603 of the Handbook of Common Polymers, Fibres, Films, Plastics and Rubbers, C.R.C. Press, A Division of the Chemical Rubber Co., Cleveland, Ohio, 1971.

Once molecular orientation of the stretched polymer is obtained, it is locked in or set to prevent the oriented molecules from relaxing and returning to their previous random coil configuration. Molecular orientation of substantially crystalline, semi-crystalline and substantially amorphous materials can be effected by quenching, that is, by a rapid cooling of the stretched material, usually to below its glass transition temperature. Molecular orientation of certain materials such as nylon 6 or 6,6 can also be and preferably is locked in by crytallization by a thermal conditioning which involves rapidly heating the material to heat setting temperatures of about 215° to 232° C. respectively. Orientation of materials such as polypropylene can be set by polymer crystallization which accompanies the orientation. As previously stated, preferably the oriented thermoplastic polymeric materials employed are not heat set so that the temperature employed to release or reverse the level or orientation is low. The molecular orientation of heat set materials is released by heating the material to above the temperature at which it was heat set.

Briefly, the glass transition temperature, or glass temperature, is the temperature range for a given material below which configurational rearrangements of polymer chain backbones, if they occur at all, are extremely slow. Therefore, molecular orientation will be maintained as long as the polymer is not reheated above its glass transition temperature. The glass transition temperature of a thermoplastic polymeric material, usually expressed as Tg, is not a measurable specific temperature at which properties of the materials change discontinuously with respect to temperature. Rather, it is a temperature range, usually several degrees over which polymer properties undergo relatively large rates of change in the transition from the glassy to the leathery states. For example, the elastic moduli and viscosity, as shown by the rate of irreversible creep of a polymer, decrease only slowly with increasing temperature in the glassy state until a temperature where both of these qualities drop rather drastically over a narrow range of from about 2° to 5°.

Glass transition temperatures of polymeric materials have been determined and are reported in currently available literature. For example, a very comprehensive list of representative glass transition temperatures of polymeric materials is compiled in an article entitled The Glass Transition Temperatures of Polymers, by W. A. Lee and G. J. Knight, Royal Aircraft Establishment, Farnborough, Hants, England, in Chapter III, pages 61–91 of the aforementioned Polymer Handbook. A more recent comprehensive list is compiled in an article of the same title by W. A. Lee and R. A. Rutherford, in Chapter III, pages 139–191 of the Polymer Handbook, John Wiley & Sons, Inc., New York, 2nd Edition, 1975. Less extensive lists of glass transition temperatures of thermoplastic materials are provided in Polymers: Structure and Bulk Properties, by P. Meares, Van Nostrand Reinhold Company Ltd., 1965, and in Materials Science for Engineers, Lawrence H. Van Vlack, Addison-Wesley Publishing Company, Inc., 1970. Second order transition temperatures are listed in Man-Made Fibres, by R. W. Moncrieff, John Wiley & Sons, 6th Edition, 1975, and in the previously mentioned Patent which lists such temperatures of certain amorphous polymers and crystallizable polymers that are amorphous as quenched. As discussed in the previously mentioned articles and in the works of Meares and Moncrieff, various published values of glass transition temperatures, measured of polymers of the same name, may differ due to the fact that they may have been prepared by different methods and may not have been of corresponding chemical structure, molecular weight, density, purity, or degree of crystallinity, orientation, or internal stress. Also, the glass temperature of corresponding materials may have been determined by different rates and methods of measurement. The main factor that affects the glass transition temperature of a thermoplastic polymeric material is the chemical structure of its polymer chain units. For example, polar groups increase inter-molecular forces, pull molecular chains together and tend to raise the glass temperature. Stiff and bulky side groups provide steric hindrances to free rotation of chain segments and also increase the glass temperature. Flexible side groups tend to hold molecular chains apart, free their motions and decrease the glass temperature. The glass temperature is also affected, for example, by the rate at which the material is cooled into the glassy state after orientation. Slow cooling tends to provide lower glass temperatures than rapid cooling.

In accordance with the method of this invention, the lasting pieces made of oriented polymeric, preferably thermoplastic, materials and preferably in the form of lasting strings attached to shoe uppers preferably by lapping their free end portions, as shown in FIGS. 31 and 33, are heated to a temperature which allows the oriented molecules to revert to their more randomly coiled configurations to an extent that the changes in physical characteristics of the polymeric materials which occur during the reversion are sufficient to last a shoe upper to a last in the manner explained. The extent that the oriented molecules revert to their more coiled configurations and therefore the extent of shrinkage of the lasting piece, is dependent upon the polymer, its chemical structure, its past history, particularly the conditions under which it was oriented, its level or extent of orientation, and the time during which and the temperature at which it is heated to reverse or reduce the orientation. Although molecular orientation is sometimes reversable or reducable at temperatures above the melting point, it is preferred that the reversal or reduction of the level of molecular orientation of the oriented thermoplastic polymeric lasting pieces of this invention be effected by heating the materials to a temperature higher than their glass transition temperature but below their melting temperature, within the orientation temperature range of the particular polymeric material. As the stretched molecular chains are heated to within this range, they revert to their more coiled configurations and the lasting piece shrinks. Some of the work that was involved in stretching and that is recoverable, is believed utilized for lasting a shoe upper to a last.

The direction of shrinkage is along the path of and opposite to the directions of stretching. Thus, shrinkage of a lasting string 16 made of monofilament is demonstrated as a reduction in length, and shrinkage of a lasting sheet 100 would, if equally biaxially oriented, shrink in each direction that it had been oriented. It is advantageous that orientation and therefore shrinkage be greater biaxially across the instep and arch of the lasting sheets to provide any needed relatively greater shrinkage and greater pulling of the shoe upper lasting margin thereacross.

Table I lists the second order or glass transition temperatures, melting temperatures or crystalline melting points, and, in some instances, the orientation temperature ranges, of certain of the more common and preferred thermoplastic polymeric materials which are exemplary of the thermoplastic polymeric materials which can be oriented and utilized as lasting pieces in accordance with the method of this invention.

TABLE I

| Thermoplastic Polymer | Density at 20° C (gm/cc.) | Glass Transition T° | Orientation T° Range | Melting T° | Ref. |
|---|---|---|---|---|---|
| Polyethylene | .90 | — | 50–80 | 98 | (1) |
| Polyethylene | .92 | — | 80–110 | 112.5 | (1) |
| Polyethylene | .95 | | 120–130 | 134 | (1) |
| Polyethylene | | −120 | — | 137 | (2) |
| Polyethylene | | −100 | — | — | (4) |
| Polyethylene | | −125 | — | — | (8) |
| Polyethylene | | −68 | | | (9) |
| Polyethylene Terephthalate | | 70 | 85–110 | 255 | (1) |
| Terephthalate | | | | 250 | (5) |
| (Terylene)* | | 80 | | | (4) |
| (Terylene)* | | 69 | | | (8) |
| (Terylene)* | | | | 249 | (4) |
| Polyvinyl Chloride | | 87 | | 175 | (2) |
| Polyvinyl Chloride | | 81 | | | (8) |
| Polyvinyl Chloride w/o plasticizer | | 105 | 115–145 | 170 | (1) |
| 5% plasticizer | | 90 | 100–130 | 170 | (1) |
| 10% plasticizer | | 75 | 85–115 | 170 | (1) |
| 15% plasticizer | | 60 | 70–100 | 170 | (1) |
| Polyvinyl Chloride | (96.9)[3] | | | 190 | (6) |
| Polyvinyl Chloride | | | | 165 | (5) |
| Polyvinylidene Chloride | | −17 | | | (9) |
| Polyvinylidene Chloride | | −18 | | | (8) |

TABLE I-continued

| Thermoplastic Polymer | Density at 20° C (gm/cc.) | Glass Transition T° | Orientation T° Range | Melting T° | Ref. |
|---|---|---|---|---|---|
| Polypropylene | | −15 | | 175 | (2) |
| Polypropylene | | −35 | | | (4) |
| Polypropylene | | | | 165 | (5) |
| Polypropylene | .8825 | | 100–200 | 140 | (1) |
| Polypropylene | .8921 | | 120–140 | 150 | (1) |
| Polypropylene | .9041 | | 125–145 | 165 | (1) |
| Polypropylene | .9012 | | 135–160 | 173 | (1) |
| Polypropylene | .9123 | | 140–160 | 179 | (1) |
| (isotactic) | | −35 to −13 | | | (8) |
| (isotactic) | | −10 | | | (4) |
| Polyacrylonitrile | | 110 | | 320 | (2) |
| Polyacrylonitrile | | 97 | | | (8) |
| Polyacrylonitrile (syndiotactic) | (53.06)[3] | | | 317 | (6) |
| Polystyrene | | | 88–110 | 88–120[a] | (1) |
| Polystyrene (isotactic) | | 100[b] | | 240 | (2,8) |
| Polystyrene | (104.14)[3] | | | 240 | (6) |
| Polystyrene | (104.14)[3] | | | 250 | (6) |
| Polystyrene | (104.14)[3] | | | 235 | (6) |
| Polystyrene | | | | 163 | (5) |
| Polystyrene | | 75[c] | | | (7) |
| (atactic) | | 100 | | | (8) |
| Polystyrene | | 81 | | | (9) |
| Polyethylene -2,6-naphthalate | | 113 | 120–140 | 265 | (1) |
| Polyethylene -1,5-naphthalate | | 71 | 80–100 | 225 | (1) |
| Polyhexamethylene adipamide | | 45–50 | 65–75 | 250 | (1) |
| (Nylon 6,6) | (226.31)[3] | | | 265 | (6) |
| (Nylon 6,6) | (226.31)[3] | | | 270 | (6) |
| (Nylon 6,6) | | | | | (6) |
| (Nylon 6,6) | | | | | (8) |
| (Nylon 6,6) | | 47 | | | (9) |
| Polyhexamethylene sebacamide | | | | | |
| (Nylon 6,10) | | 45–50 | 65–75 | 250 | (1) |
| (Nylon 6,10) | | 50 | | | (8) |
| (Nylon 6,10) | (282.42)[3] | | | 228 | (6) |
| (Nylon 6,10) | (282.42)[3] | | | 216 | (6) |
| (Nylon 6,10) | (282.42)[3] | | | 233 | (6) |
| (Nylon 6,10) | (282.42)[3] | | | 215 | (6) |
| (Nylon 6,10) | | | | 215 | (5) |
| Polycaprolactam | | | | | |
| (Nylon 6) | | 45–40 | 65–75 | 250 | (1) |
| (Nylon 6) | | | | 218 | (5) |
| (Nylon 6) | | 40–87 | | | (8) |
| Copolymer of 70% Ethylene Terephthalate/ 30% Ethylene Isophthalate | | 51 | 70–90 | 170 | (1) |
| Polyvinyl Acetate | | 29 | | | (7) |
| Polyvinyl Acetate | | 32 | | | (8) |
| Polymethyl Acrylate | | 0 | | | (7) |
| Polymethyl Acrylate | | 10 | | | (8) |
| Polymethyl Methacrylate | | 72 | | | (7) |
| (random) | | 105 | | | (8) |
| (isotactic) | | 38 | | | (8) |
| (isotactic) | | 55 | | | (8) |
| (syndiotactic) | | 105 | | | (8) |
| Polymethyl Methacrylate | | | 66–105 | 66–111 | (1) |
| (isotactic) | (100.11)[3] | | | 160 | (6) |
| (isotactic) | | 38 | | | (8) |
| (syndiotactic) | (100.11)[3] | | | 200 | (6) |
| (syndiotactic) | | | | 160 | (6) |
| (syndiotactic) | | | | 200 | (6) |
| (syndiotactic) | | 105 | | | (6) |
| (atactic) | | 105 | | | (6) |

*Trademark owned by I.C.I. Ltd., of the United Kingdom.
[a]Softening range.
[b]Relatively high molecular weight.
[c]Lower Molecular weight than [b]
[1]U.S. Pat. No. 3,141,192, issued July 21, 1946. Temperatures listed under Glass Transition Temperature in TABLE I are listed in the Patent as second order transition temperatures and, where applicable, as crystalline melting points.
[2]Materials Science for Engineers, Lawrence H. Van Vlack, Addison-Wesley Publishing Company, Inc., 1970.
[3]Molecular weight, not density. The molecular weight is that of the chemical repeat in the polymer.
[4]Man-Made Fibres, R. W. Moncrieff, John Wiley & Sons, 6th Edition, 1975.
[5]"Simplified Procedure for Identification of Man-Made Filaments", Bulletin No. 4, Technical Data Sheet A-77630, 9/71, by E. I. Du Pont de Nemours & Co., Plastics Dept., Wilmington, Delaware.
[6]"Polymer Handbook", J. Brandrup and E. H. Immergut, Editors (with H. G. Elias), Interscience Publishers, A Division of John Wiley & Sons, 1965.
[7]"Polymers: Structure and Bulk Properties", by P. Meares, Van Nostrand Reinhold Company Ltd., 1965.
[8]Article entitled "Glass Transition Temperatures of Polymers" W. A. Lee and R. A. Rutherford, appearing in "Polymer Handbook", J. Brandrup, E. H. Immergut, Editors (with W. McDowell), A Wiley-Interscience Publication, John Wiley & Sons, New York, 2nd Edition, 1975. (Tg's listed in ° K converted to ° C for TABLE I).
[9]"Polymer Processing", James M. McKelvey, John Wiley and Sons, Inc., 1962.

As a demonstration that oriented thermoplastic polymeric materials can be employed as lasting pieces in

TABLE II

| Sample | Polymeric Material | Diameter Growth (%) | Shrinkage (%) | Approximate Oven Temp. (° C) |
|---|---|---|---|---|
| 1. | nylon | 9.0 | 19.0 | 204.0 |
| 2. | nylon | 8.3 | 17.2 | 204.0 |
| 3. | nylon* | 12.0 | 6.2 | 204.0 |
| 4. | nylon | 10.0 | 13.3 | 204.0 |
| 5. | nylon | 4.0 | 9.4 | 135.0 |
| 6. | nylon | 7.0 | 12.5 | 204.0 |
| 7. | nylon | 8.0 | 17.2 | 232.0 |
| 8. | polypropylene | ** | 15.0 | 93.0 |
| 9. | polypropylene | ** | 25.0 | 121.0 |
| 10. | polypropylene | ** | 55.0 | 149.0 |
| 11. | polypropylene | ** | 55.0 | 177.0 |
| 12. | polypropylene[A] | | 41.3 | 191.0 |
| 13. | polypropylene[A] | ** | 42.2 | 135.0 |
| 14. | polypropylene[A] | ** | 41.2 | 177.–191. |
| 15. | polypropylene[A] | ** | 41.0 | 191.0 |
| 16. | medium density polyethylene | 32.3 | 35.3 | 191.0 |
| 17. | polyethylene | 26.7 | 35.6 | 177.0 |
| 18. | polyethylene | 27.8 | 30.4 | 149.0 |
| 19. | polyethylene[B] | 25.8 | 17.6 | 149.0 |
| 20. | polyethylene | 16.0 | 25.0 | 163.0 |
| 21. | polyethylene | 33.3 | 28.0 | 177.0 |
| 22. | saran[C] | ** | 30 | 135.0 |
| 23. | saran | ** | 25 | 177.0 |
| 24. | saran | ** | 35 | 143.0 |
| 25. | saran | ** | 20 | 93.0 |
| 26. | polyvinyl chloride | ** | 25 | 93.0 |
| 27. | polyvinyl chloride | ** | 40 | 121.0 |
| 28. | polyvinyl chloride | ** | 50 | 149.0 |
| 29. | polyvinyl chloride | ** | 50 | 163.0 |
| 30. | polyvinyl chloride | ** | 55 | 163.0 |
| 31. | terylene[A] | ** | ** | 288.0 |
| 32. | terylene[A] | ** | 33.0 | 260.0 |
| 33. | terylene[A] | ** | 34.2 | 274.0 |
| 34. | terylene[A] | ** | 32.0 | 204.0 |
| 35. | terylene[A] | ** | 33.1 | 232.0 |
| 36. | terylene | ** | 33.0 | 260.0 |

*Two loops of 80 lb. test fishing line.
**Not measured; (shrinkage of sample 31 not measured because multifilament strands placed in the form of twin loops fused together upon heating at the listed temperature.)
[A]Braided multifilament, i.e. multifilament comprised of braided monofilaments.
[B]This sample lasting string was wound about hooks of a shank placed on the board.
[C]Vinylidene chloride; the width of the length of the saran film was rolled upon itself and used in the rolled fashion.

TABLE II demonstrates that when lasting strings are made of oriented thermoplastic polymeric materials and are heated, they undergo a certain shrinkage or reduction in length and this can be utilized for lasting a shoe upper to a last. The Table also shows that lasting strings can increase in diameter when they shrink.

TABLE III

| Lasting String Material | Lasting String Diameter (inches) | Shoe Upper Material | Oven Temperature (° C) |
|---|---|---|---|
| Polyethylene (medium density) | 0.090 | Cloth* | 165 |
| Nylon | 0.125 | Cloth* | 230 |
| Nylon | 0.090 | Cloth* | 210 |
| Polyvinylchloride | 0.090 | Cloth* | 165 |
| Polypropylene (twisted) | | Cloth* | 175 |
| Polyvinylchloride | 0.090 | Cloth* | 170 |
| Polypropylene (twisted) | | Cloth* | 175 |
| Saran (Rolled)** | | Cloth* | 180 |
| Terylene | 0.090 | Cloth* | 250 |
| Polyethylene | 0.093 | 4 oz leather | 170 |
| Polyethylene | 0.093 | 4 oz leather | 165 |
| Nylon | 0.125 | 4 oz leather | 220 |
| Nylon | 0.125 | 4 oz leather | 225 |
| Polypropylene (twisted) | | 4 oz leather | 170 |
| Polypropylene (twisted) | | 4 oz leather | 175 |
| Polyethylene (medium density) | 0.090 | 6 oz leather | 165 |
| (medium density) | 0.125 | 6 oz leather | 165 |
| Nylon | 0.125 | 6 oz leather | 220 |
| Nylon | 0.125 | 6 oz leather | 220 |
| Polypropylene (Twisted) | | 6 oz leather | 175 |
| (Twisted) | | 6 oz leather | 175 |
| (Twisted) | | 6 oz leather | 175 |

*Dry canvas of type commonly used as shoe uppers for sneakers, athletic shoes, and tennis shoes.
**Width of elongated strip of 0.25 mils thick film rolled transaxially upon itself into an elongated rolled lasting string.

TABLE III shows that oriented thermoplastic materials can be used as lasting strings to last shoe uppers to lasts according to the methods of this invention. Various oriented thermoplastic materials in the form of lasting strings were hand overstitched along the lasting margins of shoe uppers made of various materials. Each overstitched shoe upper was mounted on a last and then placed in an electrically heated oven and heated at a temperature known to be in excess of the glass transition temperature of the particular oriented polymeric material employed as the lasting string. All leather uppers were soaked in clear water for approximately 3 hours after having strings affixed thereto and prior to being placed on a last. Each mounted upper was so heated at the listed oven temperature until the lasting string shrank and thereby lasted the shoe upper to the last, in the manner shown in FIGS. 5 and 6. Two lasts or footforms were used, one made of solid aluminum, and the other of solid wood. Cloth shoe uppers were mounted on the former, and leather ones on the latter. The lasting strings were solid, i.e. not hollow, except for the saran one, and the polypropylene ones which were twisted fibers. The leathers were soft and pliable in their dried states and were of a thickness indicated by ounces wherein 1.0 ounces (oz) equal 1/64 inch thickness. Thus, the 4 ounce material was 0.0625 inch thick, and the 6 ounce material was 0.09375 inch thick.

When the lasting pieces employed are oriented lasting films or sheets 162 and 168, or lasting strips 163, the sheets or strips undergo shrinkage in the manner of shrink films employed in shrink packaging operations. TABLE IV shows typical shrink temperatures and maximum shrinkage percents obtainable from commonly used shrink packaging film materials. The maximum shrink percent value is based on the original dimensions of the film prior to its being heated and is obtained by immersing a marked film sample in water for 5 seconds for temperatures below 100° C., or in silicone oil for temperatures above 100° C.

TABLE IV

| Film Material | Typical Thickness (Mils) | Film Shrink Temp. Range (° C) | Tunnel Air Temp. Range (° C) | Shrink Maximum (%) |
|---|---|---|---|---|
| Ionomer | 1.0–3.0 | 91–132 | 121–177 | 20–40 |
| Polyethylene (Cast) | | | | |
| (Cast) Regular | 1.0–2.0 | 88–149 | 121–191 | 20–70 |
| (Cast) Heavy Duty | 2.0–10.0 | 88–149 | 121–246 | 20–70 |
| Polyethylene (Oriented) | | | | |
| Regular and Modified | 0.6–2.0 | 88–138 | 110–177 | 70 |
| (cross-linked) | 0.6–1.5 | 71–143 | 107–316 | 50–80 |
| Polybutylene | 0.5–2.0 | 88–177 | 121–204 | 40–80 |
| Polypropylene | | | | |
| Regular | 0.5–1.5 | 93–177 | 149–232 | 50–80 |
| Polystyrene | 0.5–3.0 | 99–132 | 132–160 | 30–70 |
| Polyvinyl Chloride | | | | |
| Regular | 0.75 | 66–149 | 107–154 | 30–70 |
| Heavy Duty | 1.5–3.0 | 66–149 | 107–154 | 55 |

TABLE IV-continued

| Film Material | Typical Thickness (Mils) | Film Shrink Temp. Range (° C) | Tunnel Air Temp. Range (° C) | Shrink Maximum (%) |
|---|---|---|---|---|
| Polyvinylidene Chloride-vinyl Chloride copolymer | 0.4–1.0 | 60–143 | 93–149 | 15–60 |
| Ethyl-vinyl acetate copolymer | 1–10 | 66–121 | 93–160 | 20–70 |

When the polymeric materials of which the lasting pieces employed in this invention are fabricated, are heated and undergo shrinkage, a shrinkage force is exerted by the material. It is this shrinkage force which pulls or draws the lasting margin of a shoe upper over a last sole and thereby lasts the shoe upper to the last. Table V shows shrinkage forces which can be exerted during shrinkage of lasting strings made of common oriented polymeric materials. The data for Table V was obtained by use of a Chatillon Model DPP Gauge, manufactured and sold by John Chatillon and Sons, Inc. and adapted to measure the contraction or shrinkage force of the lasting strings of this invention. Test procedures were similar to those stated in ASTM D1504. The free ends of each lasting string specimen were clamped by and extended tightly between the holders of the Chatillon Gauge. The shrinkage force dial was set at zero and then the specimen was immersed in a hot silicon oil bath heated and temperature controlled by a resistance heater and a Variac (Trademark owned by General Radio Company). While the specimen was immersed, the bath temperature was gradually raised until the specimen shrunk. The holder contraction or specimen shrinkage indicated by the dial was recorded. After the specimen was tested it was removed from the Gauge. The procedure was repeated for each specimen.

TABLE V

| Lasting String Polymeric Material | Diameter of Lasting String (Inches) | Shrinkage Temperature (° C) | Shrinkage Force Pounds |
|---|---|---|---|
| Polyethylene (high density) | .093 | 130 | 4. |
| (high density) | .090 | .30 | 4. |
| Polyethylene** | .087 | 130 | 4. |
| Polyvinyl Chloride (solid) | .146 | 177 | 0.*** |
| (solid) | .055 | 177 | 0.*** |
| Polyvinyl Chloride | | | 0.*** |
| (hollow) | .115 | 177 | 0.*** |
| Polypropylene (braided) | — | 170 | 5. |
| (braided) | — | 170 | 6.5 |
| (braided) | — | 170 | 6.75 |
| (braided) | — | 177 | 7. |
| Terylene (braided multifilament) | — | 225 | 5.5 |
| Terylene (braided multifilament) | — | 225 | 5. |
| Nylon**** | .125 | 215 | .0 |
| Nylon**** | .125 | 260 | 10.5 |
| Nylon**** | .075 | 271 | 11.5 |
| Nylon**** | .075 | 273 | 11. |
| Nylon**** | .125 | 260 | 10. |

*Temperature of oil bath in which lasting string immersed when shrinkage occurred.

**This lasting string was bent at half of its length and folded back on itself to resemble an elongated compressed "U". One holder of the gauge was clamped onto the folded end and the other was clamped on the free ends.

***These materials are assumed to be unoriented because when stretched and released they behaved like rubber bands.

****Orientation of these materials assumed to have been heat set at a temperature between 215° C and 260° C.

The shrinkage force exertable by a lasting piece must be sufficient to last a shoe upper to a last. Shrinkage forces of a multitude of polymeric materials are not given here since the shrinkage force of oriented polymeric materials vary depending for example upon the type of polymeric material employed, the manner in which it was formed, the extent of its orientation, and the particular orientation and shrinkage conditions employed. Whether the shrinkage force of a given material is sufficient also depends on the resistive or tensile strength of the shoe upper material to be lasted, which in turn depends for example on the weight or thickness of the shoe upper material, whether it is cloth, canvas or light or heave gauge leather, and whether and to what extent the material has been wetted or softened.

The type of lasting piece and the type of shrinkable polymeric material employed are selected as desired in accordance with the intended application. For example, materials capable of exerting great shrinkage force are desirable for lasting shoe uppers made of relatively stiff, high strength materials such as leathers for boots and shoe uppers, while materials capable of less shrinkage force are more suitable for light-weight shoe uppers made of softer materials such as calf skin for shoe uppers and slippers, deerskin for moccasins and canvas for sneakers. High shrinkage forces can be obtained by use of multiple lasting pieces, for example by multiple loops of a lasting string.

The shrinkage force needed also depends on the tightness and frictional resistive force of the stitching employed to attach say a lasting string to a shoe upper lasting margin, and on how tightly or loosely the shoe upper to be lasted fits on the last. Although the polymeric materials employed as lasting strings can be natural or man-made, they should be compatible with shoe upper and other footwear materials employed in terms of for example relative wet strengths, and abilities to withstand shrinking conditions, especially the temperatures employed. Thus, selection of types of lasting pieces, shrinkable polymeric materials, shoe upper materials, as well as selection of shrinkage temperatures, times and conditions will vary in different situations and therefore cannot practically be delineated here. It is a matter of needs and suitability depending on the situation.

Polymeric materials include copolymers of materials listed herein. For example, what may be commercially sold as a polyethylene may in fact include a minor amount of another polymer as a strengthener.

According to this invention, thermoplastic polymeric materials include fibre-forming polymers, preferably high polymers, and include polyolefins, for example, polyethylene, for example, that made by Courtlands Ltd. of the United Kingdom and sold under the trademark Courlene, and that made by Phillips Petroleum Co., and sold under the trademark Marlex and polypropylene, for example, that made by Montecatini of Italy and sold under the trandmark Meraklon, and that made by I.C.I., Ltd. of the United Kingdom and sold under the trademark Ulston; polyacrylates, for example, high shrinkage polyacrylonitriles and acrylonitrile-based polymers, preferably containing more than 85 percent by weight acrylonitrile, although high shrinkage modacrylic polymers having from 35 to 85 percent by weight acrylonitrile can also be used, examples of high shrinkage modacrylics being that manufactured by the Tennessee Eastman Co. and sold under the trademark Verel Type III, and a copolymer of 40 percent acrylonitrile and 60 percent vinyl chloride dissolved in an acetone solution, manufactured by Union Carbide Chemicals Company and sold under the trademark Type 63 Dynel; polymethacrylates and polymethyl methacrylates, polystyrenes; vinyl and vinylidene polymers, for example polyvinyl acetate, polyvinyl chloride, resin copolymers having a molecular weight ranging from 10,000 to 28,000 and produced by simultaneous polymerization of vinyl chloride and vinyl acetate, such as manufactured by the American Viscose Corporation and sold under the trademark Vinyon, vinylidene and polyvinylidene chlorides, polyvinyl alcohols, for example as manufactured by Kurashiki Rayon Co. Ltd. of Japan and sold under the trademark Vinylon; polyamides, including polycaprolactam (Nylon 6), polyhexamethylene apidamide (Nylon 6,6), and polyhexamethylene sebacamide (Nylon 6,10); polyurethane nonelastic melt spun fibre-forming polymers such as made by reacting 1-4-butanediol with hexamethylene diisocyanate at 195° C; polyesters, for example polyethylene 1,5-naphthalate, polyethylene 2,6-naphthalate, and polyethylene terephthalates, for example the previously mentioned materials sold under the trademarks Terylene and Dacron, and polymers of 1,4-cyclohexamethanediol and terephthalic acid such as manufactured by Eastman Chemical Products and sold under the trademark Kodel; cellulose derivatives or cellulosics such as regenerated celluloses made by stretching cellulose acetate in steam under pressure and saponifying the stretched yarn with alkali such as manufactured by Celanese Fibres Corporation and sold under the trademark Fortisan, and such as the sodium and zinc cellulose xanthate viscose rayons such as manufactured by Courtaulds Ltd. of the United Kingdom. The aforementioned materials and methods of manufacturing them are well known and described in the literature, such as in the aforementioned Man-Made Fibres by R. W. Moncrieff.

It is thought that the invention and many of its attendant advantages will be understood from the foregoing description and it will be apparent that various changes may be made in the form, construction and arrangement of parts of lasted shoe uppers and articles of footwear produced by the methods, and that changes may be made in the steps of the methods described and their order of accomplishment without departing from the spirit and scope of the invention or sacrificing all of its material advantages, the forms herein described being merely preferred embodiments thereof.

What is claimed is:

1. A method of lasting a shoe upper having a lasting margin, to a last, which comprises:

attaching a lasting piece made of shrinkable polymeric material to the shoe upper lasting margin, shrinking the polymeric material, and utilizing the shrinkage of the polymeric material to last the shoe upper to the last.

2. The method of claim 1 wherein the polymeric material is oriented and the shrinking step is effected by heating the lasting piece to a temperature which is effective to reduce the orientation of the polymeric material of which the lasting piece is made.

3. The method of claim 2 wherein the oriented polymeric material is thermoplastic.

4. A method of lasting a shoe upper having a lasting margin, to a last, which comprises:

attaching a lasting piece made of oriented polymeric material to the shoe upper lasting margin, effecting a reduction in the extent of molecular orientation of the polymeric material, and utilizing the change in physical dimensions of the lasting piece which occurs during the reduction of molecular orientation, to last the shoe upper to the last.

5. The method of claim 4 wherein the oriented polymeric material is thermoplastic.

6. The method of claim 5 wherein the effecting step is done by heating the lasting piece to a temperature between the glass transition temperature and the melting point of the thermoplastic polymeric material of which the lasting piece is made.

7. The method of claim 4 wherein the attaching step is effected by stitching the lasting piece to the shoe upper lasting margin.

8. A method of lasting a shoe upper having a lasting margin, to a last, which comprises:

attaching a lasting piece made of oriented polymeric material to the shoe upper lasting margin, heating the lasting piece to reduce the extent of molecular orientation of the polymeric material and thereby shrink the lasting piece, and utilizing the shrinkage of the lasting piece which occurs during the reduction in the extent of molecular orientation to last the shoe upper to the last.

9. The method of claim 8 wherein the oriented polymeric material is thermoplastic.

10. The method of claim 9 wherein the heating step is effected by heating the lasting piece to a temperature between the glass transition temperature and the melting point of the thermoplastic polymeric material of which the lasting piece is made.

11. The method of claim 8 wherein the attaching step is effected by stitching the lasting piece to the shoe upper lasting margin.

12. The method of claim 10 wherein the attaching step is effected by stitching the lasting piece to the shoe upper lasting margin.

13. A method of claim 10 wherein the thermoplastic polymeric material is polyethylene.

14. The method of claim 10 wherein the thermoplastic polymeric material is polypropylene.

15. The method of claim 10 wherein the thermoplastic polymeric material is a polyamide.

16. A method of claim 10 wherein the thermoplastic polymeric material is a polystyrene.

17. The method of claim 10 wherein the thermoplastic polymeric material is a polyethylene terephthalate.

18. The method of claim 10 wherein the thermoplastic polymeric material is a polyvinyl chloride.

19. The method of claim 10 wherein the thermoplastic polymeric material is a polyvinylidene chloride.

20. The method of claim 8 wherein the lasting piece is a lasting string.

21. The method of claim 8 wherein the lasting piece is an endless lasting band.

22. The method of claim 8 wherein the lasting piece is a lasting sheet.

23. The method of claim 22 wherein the lasting sheet is perforated.

24. The method of claim 8 wherein the lasting piece is a lasting web.

25. The method of claim 8 wherein the lasting piece is a lasting strip.

26. The method of claim 8 wherein the lasting piece is a lasting welt.

27. The method of claim 20 wherein the lasting string has free ends and the attaching step is effected by stitching the lasting string to the lasting margin in a manner that the lasting string portions adjacent the free ends are lapped over other portions of the lasting string.

28. The method of claim 20 wherein the attaching step is effected by attaching an attaching piece to the lasting margin, in a manner that holds the lasting string therein.

29. The method of claim 20 wherein the lasting string is a monofilament.

30. The method of claim 20 wherein the lasting string is a multifilament.

31. The method of claim 30 wherein the multifilament is made of braided multifilaments.

32. The method of claim 8 wherein the last has a sole portion, and wherein the utilizing step includes drawing at least a portion of the shoe upper margin over a portion of the last sole to provide a shoe upper lasted-over margin.

33. A lasted shoe upper having a lasted-over margin made according to the method of claim 32.

34. A method of forming an article of footwear from a shoe upper, which comprises:

providing a shoe upper having a lasting margin, attaching a lasting piece made of oriented polymeric material to the shoe upper lasting margin, heating the lasting piece to reduce the extent of molecular orientation of the polymeric material and thereby shrink the lasting piece, utilizing the shrinkage of the polymeric material which occurs during the reduction of its extent of molecular orientation to draw at least a portion of the lasting margin over a portion of the last sole to provide a shoe upper lasted-over margin and thereby last the shoe upper to the last, and securing a shoe sole to the lasted-over margin to form an article of footwear.

35. An article of footwear made according to the method of claim 34.

* * * * *